United States Patent [19]

Parks

[11] 4,002,292

[45] Jan. 11, 1977

[54] TIMING DEVICE FOR THERMOSTATIC-CONTROL UNITS

[76] Inventor: James G. Parks, 2463 Riverside Place, Los Angeles, Calif. 90039

[22] Filed: Aug. 25, 1975

[21] Appl. No.: 607,441

[52] U.S. Cl. ..... 236/46 R; 236/47; 200/38 BA; 74/568 T

[51] Int. Cl.[2] ..... F23N 5/20; H01H 37/02

[58] Field of Search ..... 236/47, 46 R, 46 E; 337/302, 305; 200/38 BA, 38 DA; 74/568 T, 568 M; 165/12

[56] References Cited

UNITED STATES PATENTS

| | | | |
|---|---|---|---|
| 2,172,820 | 9/1939 | Kronmiller | 236/46 X |
| 2,558,617 | 6/1951 | Kronmiller | 337/305 |
| 2,932,983 | 4/1960 | Laviana et al. | 74/568 T X |
| 3,282,126 | 11/1966 | Dykinga et al. | 74/568 |

*Primary Examiner*—William E. Wayner
*Attorney, Agent, or Firm*—Francis X. Lo Jacono, Sr.

[57] ABSTRACT

A timing device in combination with a thermostatic control whereby heating units of the type used for heating structures such as buildings can be automatically turned off during predetermined periods, as when such buildings are unoccupied, the device comprising a clock-like motor coupled to a plurality of cam discs adjustable about the output shaft of the clock mechanism, the cams including cam heads to operate control switches engaging therewith.

5 Claims, 8 Drawing Figures

TIMING DEVICE FOR THERMOSTATIC-CONTROL UNITS

BACKGROUND

1. Field of the Invention

This invention relates to timing devices and, more particularly, to a timing device in combination with a thermostatic-control unit for controlling heating conditions within a building.

2. Description of the Prior Art

As is well known at this time, various problems have arisen in the environmental balance of the earth's resources; and there is a world-wide shortage of natural fuels which are being depleted at a very rapid rate. The shortage has become such a serious problem that means must be found to reduce the waste of these natural resources. At present, natural gas is used for heating homes, office buildings and other such domestic and commercial structures which have certain periods when they are not used or occupied; hence, the need to heat such structures during these known periods provides many wasteful hours of natural gas and energy.

Generally, the well-known, thermostatic control is used to control the temperature within a building by setting a temperature-control switch to turn the heating unit off and on according to the predetermined temperature setting. That is, if a certain temperature is desired in a building, such as a home, that particular temperature will prevail as long as no one changes it or turns the unit completely off. Hence, if a home is set for a temperature of 70° during the night and the setting is not changed or turned off during the unoccupied period of the day, the heating unit will continue to operate at that temperature — thus wasting very needed fuel.

Accordingly, there is a need for a timing device in combination with a thermostatic control, wherein the unit is prevented from operating during pre-set times. When such a device, working in conjunction with the well-known heat controls, is put into operation untold amounts of natural gas can be saved.

SUMMARY

This invention provides a device for controlling the operation of thermostatically-controlled, heating units generally found in structures and buildings wherein people live and work.

This device comprises an electrically-operated, clock mechanism that operates by means of a twenty-four hour, continuous-timing movement, whereby the temperature during a selected period during a twenty-four hour cycle can be shut off or turned down by a heating system that is basically controlled by the ambient room temperature.

Coupled to the clock mechanism is a plurality of cam plates having cam heads disposed along the peripheral edge thereof. The cam heads are adjustable to provide the proper time sequences that might be needed during any given time period. The heads are positioned relative to a timing plate that provides a twenty-four hour reading.

The cam plates, together with the timing plate, are adjustably mounted to a support bushing by a lock nut and a cap nut. This then provides a complete cam-actuating means which is coupled to the output shaft of the clock mechanism. That is, the support bushing is demountably affixed to the shaft.

A micro-switch is also included therein and is adapted to directly engage the cam heads as they rotate, whereby the switch is periodically opened and closed — thereby controlling the function of the thermostatic control.

Further, the device includes its own thermostatic switch which will regulate the high-temperature zones during useful time periods, and the conventional thermostatic switch which will control a minimum, low-temperature zone.

A second embodiment is also disclosed wherein the timing device is included with both thermostatic controls as a single, integral unit to be installed at the time new buildings are constructed.

OBJECTS AND ADVANTAGES

The present invention has for an important object a provision whereby a conventional, thermostatic-control unit, in conjunction with the disclosed timing device, will eliminate wasteful consumption of natural fuels.

It is another object of the invention to provide a timing device for thermostatic control units that is simple and easy to install with the existing heat-control units now in use.

It is still another object of the invention to provide a timing device for thermostatic-control units that is compatible with mili-volt switches and other mili-volt components.

It is a further object of the invention to provide a timing device of this character that provides a twenty-four hour, controlled cycle wherein high-temperature and low-temperature ranges can be pre-set during any period of the twenty-four hour cycle.

A still further object of the invention is to provide a device of this character that is simple and rugged in construction and can be connected to existing, thermostatic-control units without making any changes thereto.

It is still another object of this invention to provide a device of this character having a relatively-long, working life.

It is a still another object of this invention to provide a device of this character that is relatively inexpensive to manufacture.

Other characteristics, advantages and objects of this invention can be more readily appreciated from the following description and appended claims. When taken in conjunction with the accompanying drawings, this description forms a part of the specification wherein like references and characters designate corresponding parts in several views.

DESCRIPTION OF THE DRAWINGS

Referring more particularly to the accompanying drawings, which are for illustrative purposes only.

DESCRIPTION OF THE PREFERRED EMBODIMENT

Figure 1:
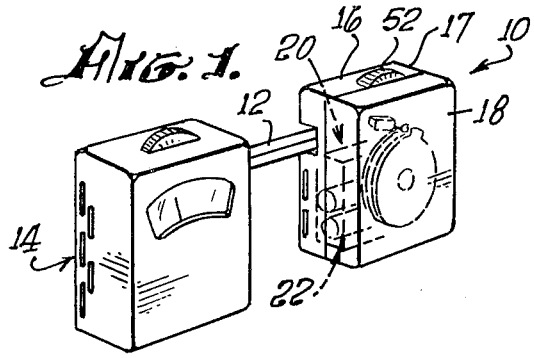
FIG. 1 is a perspective of the present invention interconnected to a conventional, thermostatic-control unit.
Figure 2:
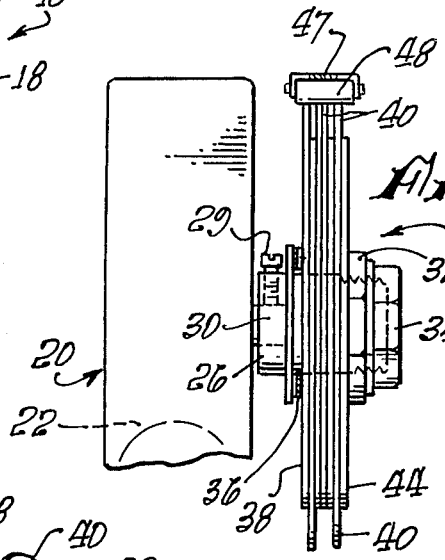
FIG. 2 is a side plan view of the clock mechanism having the complete cam-actuating means connected therewith.

Referring more particularly to the drawings, there is shown in FIG. 1 a timing device, generally indicated at 10, interconnected by wires 12 to a well-known, conventional, thermostatic-control unit, designated at 14. The control unit 14 is normally found in existing buildings for controlling the ambient temperature therein. That is, this unit is constantly operating to keep a particular area at a given comfortable temperature.

However, such a device as now in use does not provide a means by which the unit can turn off a heating system when the system is not required during periods wherein the heated area is not being occupied. Thus, the incorporation of the present invention, coupled with the existing unit, will provide untold amounts of fuel savings heretofore unobtainable.

Figure 3:
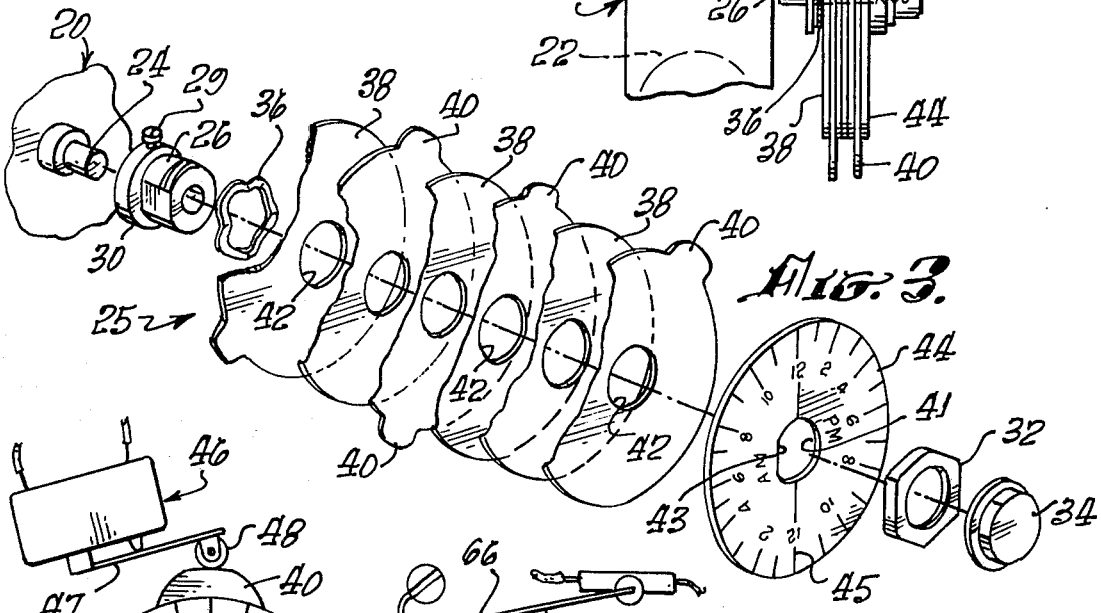
FIG. 3 is an exploded, perspective view of the cam-actuating means.

Said timing device 10 comprises a generally box-shaped housing 16 including a base-mounting portion 17 and a removable cover 18. Disposed within said housing 16 is a clock mechanism 20 of any well-known type that is operated by means of a power source which comprises a plurality of dry-cell batteries, indicated at 22. The clock 20 includes an output shaft 24, as seen in FIG. 3, which is adapted to receive a cam-actuating means, generally indicated at 25.

The cam-actuating means comprises a cam-support bushing 26 having a centrally disposed bore 28 arranged to be positioned and secured to output shaft 24 of the clock 20 by a set screw 29. The bushing also includes an enlarged-diameter shoulder 30 wherein the bushing portion adjacent thereto is threaded to accept both the lock nut 32 and cap nut 34.

Figure 7:
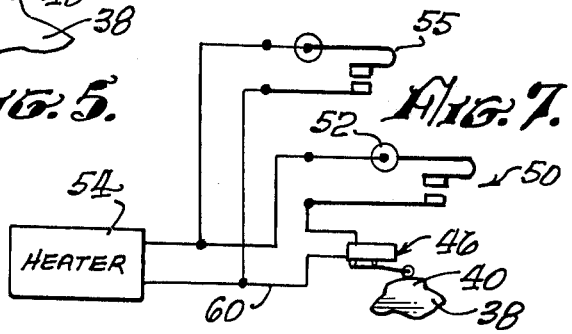
FIG. 7 is an electrical schematic of the present invention.

Adapted to be disposed over the bushing and in abutting engagement with the annular shoulder 30 is a spring washer 36 which is followed by a plurality of cam plates 38, wherein each cam plate is provided with at least one cam head 40 and a central aperture 42 which accommodates the bushing 26. After the cam plates are installed, a timing face plate 44 is superposed over the last cam plate, said timing face plate 44 providing a continuous, 24 hour reading, as indicated at 45. Thus, the cam plates can be adjusted to operably engage a switch means, generally indicated at 46 and shown in FIGS. 4 and 7, and then lock into position by nuts 32 and 34, respectively. Each timing plate includes a central aperture 41 having a flat key side 43 to match the flat portion 27 of the support bushing 26, thereby locking timing plate 44 from rotation thereon.

Figure 4:
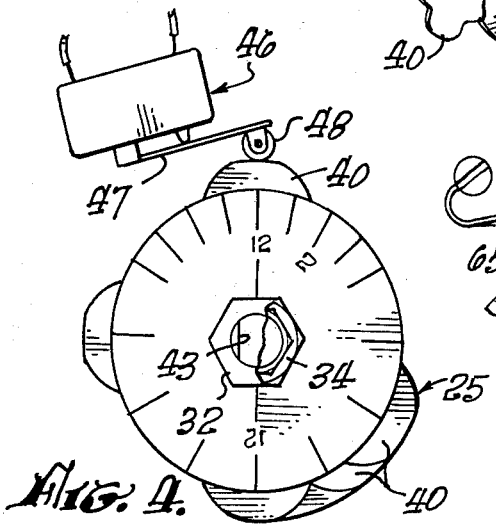
FIG. 4 is an elevational view of the timing plate showing a cam head engaging a switch means.

The switch means as seen in FIG. 4 is of the microswitch type which operates in the mili-volt range. Switch 46 includes a switch arm 47 having a contact roller 48 acting as a cam follower.

Included within the timing device and disposed within housing 16 is a thermostatic, heat-control switch 50 of the well-known type which is adapted to operate when switch 46 is closed by any one of the cam heads 40. This can be seen in the wiring diagram of FIG. 7. The control switch 50 also includes a temperature dial 52 whereby the adjustment of the dial will allow the switch 50 to close at a pre-set temperature, generally in the high-range zone — as an example, at 72°. Thus, as the cam heads engage the cam follower 48, microswitch 46 is closed, allowing switch 50 to control the ambient room temperature by operating the heating system, indicated at 54 in FIG. 7.

When said device 10 is operated in conjunction with the existing unit 14, said unit 14 has its thermostatic switch 55 set at a minimum low temperature — such, as example, at 55°. An area having a temperature below 55° becomes inefficient to heat — thus, loss of fuel will occur.

Figure 8:
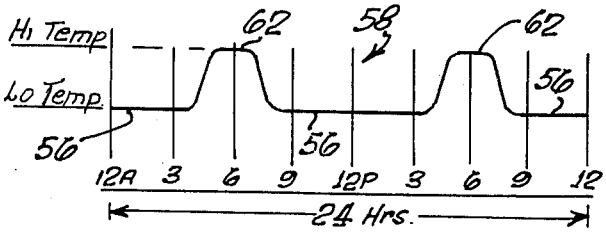
FIG. 8 is a graphic illustration of the operation of both the conventional thermostat and the present device coupled therewith.

Accordingly, the existing unit 14 is always allowed to operate at a low minimum temperature, as indicated by line 56 in chart 58 of FIG. 8. However, the upper range of temperatures is controlled by the cam's actuating switch 46 which closes circuit 60, whereby temperature-control switch 50 takes over. Hence, switch 50 only operates at predetermined intervals — this being accomplished by the proper location of cam heads 40.

It should be noted that each cam head is designed to operate the heating system 54 for one and one-half hours; however, when cam heads are grouped in an overlapping mode, such as seen in FIG. 4, a longer time period can be created.

In FIG. 8 the lower-temperature ranges operate substantially between 8:00 A.M. and 4:00 P.M. and again between 8:00 P.M. and 4:00 A.M., with the high range indicated by line 62 operating substantially between 4:00 P.M. and 8:00 P.M.

Figure 5:
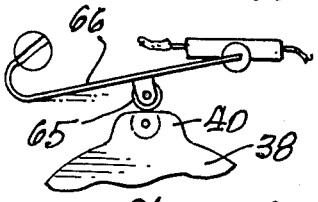
FIG. 5 is a view showing a fragment portion of a cam plate with the cam head operating a magnetically-controlled, reed switch.

Referring to FIG. 5, there is illustrated a portion of a cam plate 38 wherein the cam head 40 is shown in engagement with a cam roller 65. The cam roller is attached to a spring-biased arm 66, which is fixed at one end thereof — the opposite, free end having a magnet attached thereto. When the magnet is raised adjacent the reed switch 68 — said reed switch being of the well-known, commercial type — the reeds therein are biased closed, thus closing the circuit.

Figure 6:
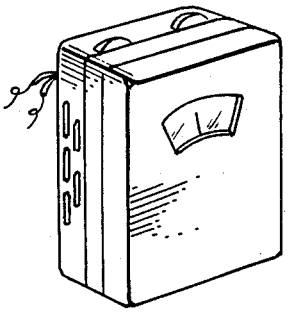
FIG. 6 is a perspective view of an alternative arrangement of the device.

In FIG. 6, there is shown an alternative unit, generally indicated at 90, wherein a single unit combines the timing device components, and both first and second temperature-control switches 50 and 55, respectively.

Accordingly, if a conventional-type unit 14 does not previously exist, then unit 70 can be installed, whereby the lower and upper heating ranges are controlled from a single, combined unit.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A timing device for thermostatic- controlled heating units wherein the combination thereof comprises:

a clock mechanism having an output shaft projecting therefrom;

a threaded, support bushing removably mounted to said output shaft and having a flat-keyed portion formed thereon;

a plurality of cam plates arranged to be selectively positioned on said bushing, said plates having at least one radially-projecting, cam head integrally formed thereon and a central opening disposed therein;

a timing plate positioned to be superposed over said cam plates whereby said cam plates are selectively positioned relative to said timing plate, wherein said timing plate includes a central aperture having a keyed, flat side to correspond to said keyed portion of said bushing, whereby rotation on said bushing is prevented thereby;

means for securing said plates to said bushing;

a timing-switch means arranged to be activated by said cam heads at predetermined intervals;

power means removably connected to said clock mechanism for the operation thereof;

a first temperature-control-switch means electrically connected to said timing-switch means, said first temperature-control switch being operated by a selective, ambient, temperature range; and a second temperature-control-switch means electrically connected to said heating unit and being selectively operative within a lower predetermined temperature range than the selective temperature range of said first temperature-control-switch means.

2. A timing device for thermostatic-control units as recited in claim 1, wherein said means for securing said plates includes:

a spring washer whereby tension is constantly applied to said cam plates;

a lock nut threadably received on said bushing, whereby said plates are secured thereon; and a cap nut superposed over said lock nut.

3. A timing device as recited in claim 2, wherein said timing switch comprises a micro-switch.

4. A timing device as recited in claim 2, wherein said timing switch comprises:

a spring-biased arm member having one end thereof fixed and the opposite end free;

a magnet attached to said free end of said arm member;

a cam roller attached to said arm for engagement with said cam plate and head thereof; and a reed switch arranged to be activated by said magnet.

5. A timing device as recited in claim 2, wherein said first temperature-control-switch means operates in an ambient temperature range higher than that of the selective operating range of said second temperature-control means, whereby the low and high ranges of the ambient temperature are pre-selected thereby.

* * * * *